US010690124B2

(12) United States Patent
Porel

(10) Patent No.: US 10,690,124 B2
(45) Date of Patent: Jun. 23, 2020

(54) AXIAL PISTON HYDRAULIC PUMP

(71) Applicant: HYDRO LEDUC, Azerailles (FR)

(72) Inventor: Louis-Claude Porel, Jeanmenil (FR)

(73) Assignee: Hydro Leduc, Azerailles (FR)

( * ) Notice: Subject to any disclaimer, the term of this patent is extended or adjusted under 35 U.S.C. 154(b) by 264 days.

(21) Appl. No.: 15/833,488

(22) Filed: Dec. 6, 2017

(65) Prior Publication Data

US 2018/0156207 A1 Jun. 7, 2018

(30) Foreign Application Priority Data

Dec. 7, 2016 (FR) ..... 16 62061

(51) Int. Cl.

| | |
|---|---|
| ***F04B 1/2007*** | (2020.01) |
| ***F04B 1/2071*** | (2020.01) |
| ***F04B 1/2021*** | (2020.01) |
| ***F04B 1/2078*** | (2020.01) |

(52) U.S. Cl.

CPC ..... *F04B 1/2007* (2013.01); *F04B 1/2021* (2013.01); *F04B 1/2071* (2013.01); *F04B 1/2078* (2013.01)

(58) Field of Classification Search

CPC ..... F01B 3/0041; F01B 3/0047; F01B 3/005; F01B 3/0067; F04B 1/2007; F04B 1/2021; F04B 1/2028; F04B 1/2071; F04B 1/2035; F04B 1/2092

See application file for complete search history.

(56) References Cited

U.S. PATENT DOCUMENTS 2,608,158 A * 8/1952 Beaman ..... F04B 1/2007 91/499
3,110,267 A 11/1963 Vetter
4,142,450 A * 3/1979 Thoma ..... F04B 1/20 91/485

FOREIGN PATENT DOCUMENTS

FR 1179738 A 5/1959

* cited by examiner

*Primary Examiner* — Kenneth J Hansen
(74) *Attorney, Agent, or Firm* — Berenato & White, LLC

(57) ABSTRACT

The invention relates to a hydraulic pump wherein a barrel is in sliding connection with a shaft and is driven in rotation by the shaft. A housing is formed in the barrel, the shaft sliding in the housing while projecting from the front face of the barrel. The housing and the shaft defining between them a balancing chamber, the balancing chamber being connected to a delivery aperture in such a way that fluid in the balancing chamber exerts a compressive force on the barrel which tends to press the barrel against a port plate.

24 Claims, 3 Drawing Sheets

SECTION A-A

SECTION B-B

AXIAL PISTON HYDRAULIC PUMP

CROSS-REFERENCE TO RELATED APPLICATIONS AND CLAIM TO PRIORITY

This application is related to Patent Application No. 1662061 filed Dec. 7, 2016 in France, the disclosure of which is incorporated herein by reference and to which priority is claimed.

FIELD OF THE INVENTION

The present invention relates to the field of axial piston hydraulic pumps.

BACKGROUND OF THE INVENTION

Hydraulic pumps with an inclined plate, or swash plate, driving axial pistons have been known for many years.

For this kind of pump, there is a known way of using what is called port plate distribution, the pistons being carried by a barrel which is driven in rotation, the rear face of the barrel being pressed by a spring against a port plate consisting of a disk with curved openings.

The delivery pressure exerts a force, proportional to the delivery pressure and to the surface of the distribution port, on the surface of the barrel facing the distribution port connected to the outlet aperture. This force tends to separate the barrel from the port plate if it exceeds the thrust exerted by the pump pistons.

The delivery pressure also exerts a force on the end walls of the piston housings, this force being proportional to the number of pistons subjected to the delivery pressure. The number of pistons subjected to the delivery pressure varies during the rotation of the barrel.

Consequently, the force exerted on the barrel and tending to press the barrel against the port plate varies during the rotation of the barrel, thus disturbing the operation of the hydraulic pump and possibly accelerating the ageing of the port plate.

The known solution in which the number of pistons is increased to reduce the variation of the force tending to press the barrel against the port plate during the rotation of the barrel is unsatisfactory, since it contributes to an increase in the production cost of the pump.

SUMMARY OF THE INVENTION

An idea underlying the invention is that of providing an axial piston hydraulic pump in which the variation of the force pressing the barrel against the port plate is reduced, even in a pump with a small number of pistons.

According to one embodiment, the invention provides a hydraulic pump comprising:

a casing in which a first and a second aperture are arranged, one of the first and second apertures being an intake aperture and the other aperture being a delivery aperture, a shaft mounted rotatably in the casing, a swash plate fixed to the casing, a barrel in sliding connection with the shaft and driven in rotation by the shaft about an axis, piston housings being formed in the barrel, at least three pistons, each sliding in one of the piston housings, the pistons projecting from the front face of the barrel and bearing against the swash plate, a port plate bearing against the rear face of the barrel, the port plate having a first port connected to the first aperture and a second port connected to the second aperture, a housing being formed in the barrel, the shaft being engaged in the housing and projecting from the front face of the barrel, the housing and the shaft defining between them a balancing chamber, the balancing chamber being connected to the delivery aperture through the casing in such a way that the fluid in the balancing chamber exerts a compressive force on the barrel which tends to press the barrel against the port plate.

The compressive force exerted by the fluid in the balancing chamber tends to move the barrel toward the port plate. This force does not vary with the rotation of the barrel relative to the port plate. Hydrostatic balancing of the barrel may be provided by the appropriate sizing of the cross sections of the piston housings and balancing chamber. Because of these arrangements, it is possible to construct a port plate pump with a small number of pistons, for example three.

According to some embodiments, such a pump may have one or more of the following characteristics.

According to one embodiment, the hydraulic pump comprises a key placed between a longitudinal groove formed in the shaft and a hole formed in the barrel, so that the key provides the sliding connection between the barrel and the shaft.

According to one embodiment, the shaft has longitudinal splines, a cylindrical longitudinal wall of the housing having complementary splines, the splines of the shaft and the splines of the housing combining to form the sliding connection.

According to one embodiment, a cavity is formed in the shaft, the cavity opening from the rear end of the shaft in the housing formed in the barrel.

According to one embodiment, the hydraulic pump further comprises a seal interposed between a cylindrical longitudinal wall of the housing and the shaft. The seal ensures the tightness of the balancing chamber while allowing the translation of the shaft relative to the barrel.

According to one embodiment, a balancing conduit is formed in the barrel, the balancing conduit connecting the balancing chamber to the rear face of the barrel, the port plate having a balancing aperture connected to the delivery aperture through the casing, the balancing aperture adjoining the balancing conduit. The balancing conduit and the balancing aperture connect the balancing chamber to the delivery aperture.

According to one embodiment, the balancing conduit and the balancing aperture are centered on the axis. Thus, the balancing conduit and the balancing aperture are always aligned during the rotation of the shaft.

According to one embodiment, the cross section Σ of the balancing chamber, the cross section s of a piston, the cross section S of the distribution port, the surface $S_2$ of the area on the rear face of the barrel subjected to a pressure in the range between the delivery pressure P and the pressure established in the pump casing, and N, the number of pistons in the pump, satisfy the following equation:

$$\sum + \frac{N-1}{2} s > S + \frac{S_2}{2}$$

This equation ensures that the barrel continues to be pressed against the port plate.

According to one embodiment, the cross section of the balancing chamber is more than twice the cross section of a piston. Thus, the compressive force exerted by the liquid in the balancing chamber on the barrel is large relative to the compressive force exerted by the liquid on the end walls of the piston housings, and the variation of the force tending to move the barrel toward the port plate during the rotation of the shaft is negligible.

According to one embodiment, the hydraulic pump is able to operate in both directions of rotation of the shaft. In a first direction of rotation of the shaft, the first aperture forms the intake aperture and the second aperture forms the delivery aperture, and in the second direction of rotation of the shaft, the second aperture forms the intake aperture and the first aperture forms the delivery aperture. The pump further comprises a valve housed in the crankcase, which is configured to connect the balancing chamber selectively to the first or second aperture, according to the direction of rotation of the shaft. Thus, in the two configurations corresponding to the two directions of operation of the pump, the balancing chamber may be put into fluid communication with the delivery aperture, so that the fluid in the balancing chamber is at the delivery pressure.

According to one embodiment, the balancing chamber is connected to the first aperture by a first passage and to the second aperture by a second passage, this valve possibly taking the form of a freely moving ball whose diameter is greater than the diameter of the first and second passages, so that the valve is pressed by the pressure of the liquid delivered by the delivery aperture against the entry of the passage connected to the intake aperture. Thus, in the two configurations corresponding to the two directions of operation of the pump, the balancing chamber is automatically put into fluid communication with the delivery aperture, so that the fluid in the balancing chamber is at the delivery pressure.

According to one embodiment, the hydraulic pump further comprises a return member which bears against the shaft, on the one hand, and against the barrel, on the other hand, to exert an elastic force tending to press the barrel against the port plate. The return member enables the barrel to be kept pressed against the port plate when the pump delivers without pressure.

According to one embodiment, the hydraulic pump comprises a thrust bearing supporting the shaft and guiding it in rotation, while limiting the translation of the shaft relative to the casing in the direction of the axis, at least in the direction in which the shaft moves away from the barrel. The compressive force exerted by the fluid in the balancing chamber tends to move the shaft away from the barrel. Since the translation of the shaft relative to the casing is constrained by the thrust bearing, the compressive force tends to move the barrel toward the port plate.

According to one embodiment, the shaft is equipped with a collar bearing on a rear face of the thrust bearing. The collar bears on the rear face of the bearing, thus limiting the movement of the shaft along its axis in the direction in which the shaft moves away from the port plate.

BRIEF DESCRIPTION OF THE DRAWINGS

The invention will be better understood, and other objects, details, characteristics and advantages thereof will be more fully apparent, from the following description of particular embodiments of the invention, provided solely for illustrative purposes and in a non-limiting way, with reference to the attached drawings.

DETAILED DESCRIPTION OF THE PREFERRED EMBODIMENT(S)

Figure 1:
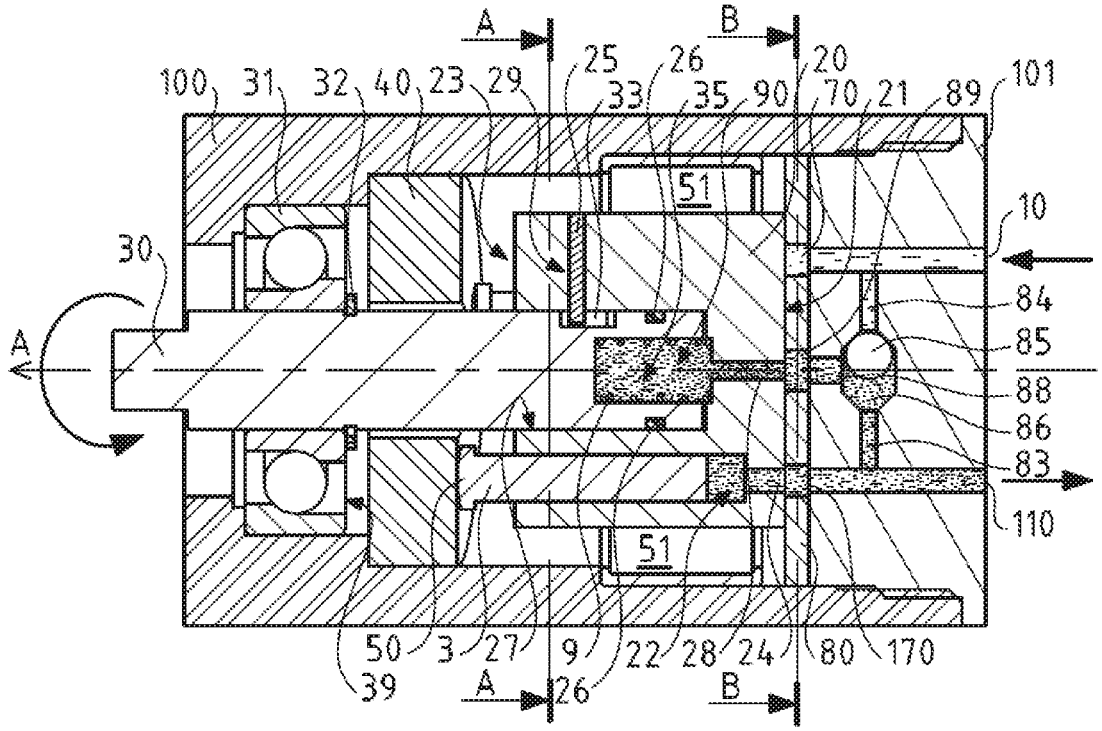
FIG. 1 is a view in longitudinal section of a hydraulic pump according to one embodiment of the invention in a first configuration.

FIG. 1 shows a hydraulic pump 1 comprising a hollow cylindrical casing 100, whose rear end is closed by an end piece 101 and in which a first 10 and a second 110 aperture are arranged. A shaft 30, a barrel 20, pistons 3, a swash plate 40, and a port plate 80 are housed in the casing 100.

Figure 2:
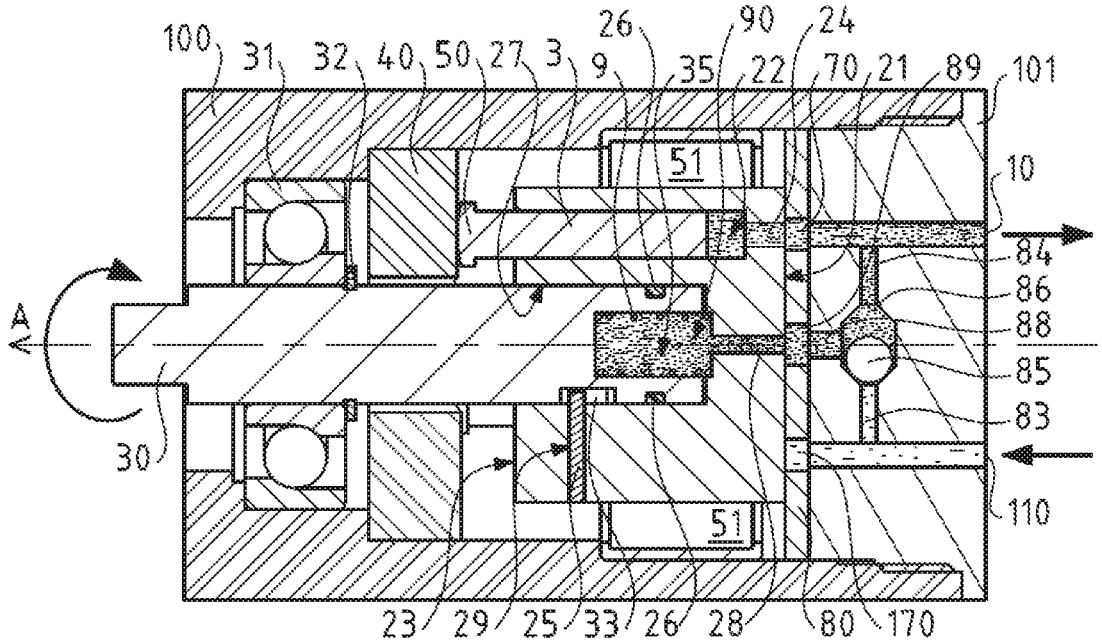
FIG. 2 is a view in longitudinal section of the hydraulic pump of FIG. 1 in a second configuration.
Figure 3:
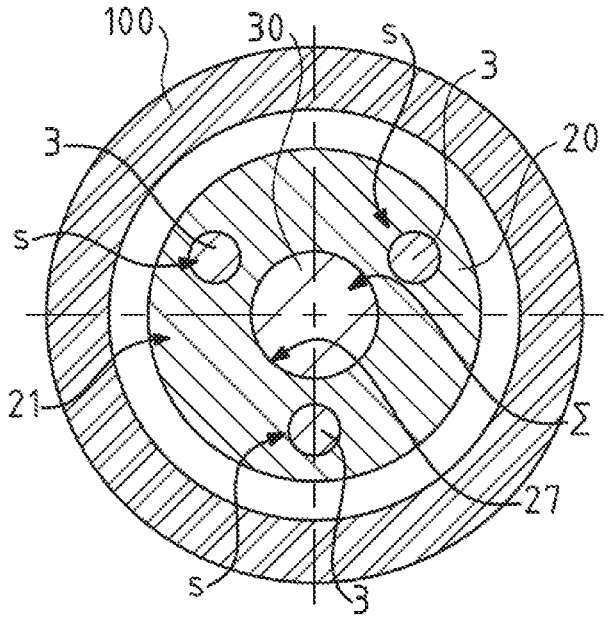
FIG. 3 is a cross-sectional view of the pump of FIG. 1, taken along the section plane AA identified in FIG. 1.

In particular, the pump may be a reversible pump; that is, it may operate in two configurations, namely a first configuration, shown in FIG. 1, in which the shaft 30 rotates clockwise, the first aperture 10 being the intake aperture and the second aperture 110 being the delivery aperture, and a second configuration, shown in FIG. 2, in which the shaft rotates counterclockwise, the second aperture 110 being the intake aperture and the first aperture 10 being the delivery aperture.

In the remainder of the text, the pump will be described in the first configuration, but it should be understood that it operates in a similar way in the second configuration.

The shaft 30 is driven in rotation relative to the casing 100. The barrel 20 is driven by the shaft 30 in rotation relative to the casing 100 around an axis of rotation A. The barrel 20 is a cylinder of circular cross section. The casing 100 forms a bearing 51 that supports the barrel 20 and guides it in rotation.

The axis of rotation A of the barrel is generally parallel to the axis of the shaft 30, but a bent shaft is a possible variant. In the remainder of the text, the terms "front" and "rear" refer to this axis oriented in the direction from the barrel 20 toward the shaft 30.

The port plate 80 is a disk fixed to the casing 100 and positioned in a plane transverse to the axis A. The port plate 80 comprises two openings in the form of circular arcs, referred to hereafter as the first 70 and the second 170 distribution port, arranged symmetrically relative to the axis A.

N denotes the number of pistons 3. There is usually an odd number of pistons 3. In particular, there may be three (3) pistons. Piston housings 22 are formed in the barrel 20. The piston housings 22 are regularly angularly distributed over a circle centered on the axis of the barrel 20. A piston housing 22 is a cylindrical housing oriented along an axis parallel to the axis of the barrel. A piston housing 22 is defined by a cylindrical longitudinal wall and an end wall. A piston channel 24 formed in the barrel 20 connects the end wall of the piston housing 22 to the rear face 21 of the barrel. The piston channels 24 are distributed over a circle centered on the axis of the barrel 20, the diameter of this circle being between the inside and outside diameters of the distribution ports 70 and 170. When the barrel 20 rotates, the piston channels 24 pass through positions facing the two distribution ports 70 and 170 alternately.

Each piston 3 slides in one of the piston housings 22 of the barrel 20. The pistons 3 project from a front face 23 of the barrel 20 and bear against the swash plate 40, by means of sliding pads 50 for example. The swash plate 40 is fixed to the casing 100 so as to form an angle, a tilt angle, relative to a plane transverse to the shaft 30. The swash plate 40 acts as a cam which imparts a reciprocating movement to the pistons 3 when the shaft 30 rotates. The tilt angle is a parameter which determines the amount of liquid pumped at each revolution of the shaft. In particular, in an embodiment that is not shown, the tilt angle may be adjustable, the pump 1 comprising a tilt angle adjustment mechanism, such mechanisms are known in the art and not detailed further here.

One of the distribution ports, the intake port 70, is connected to the intake aperture 10, while the other, the delivery port 170, is connected to the delivery aperture 110. The liquid is drawn in via the intake port 10 and delivered via the delivery port 110.

Figure 4:
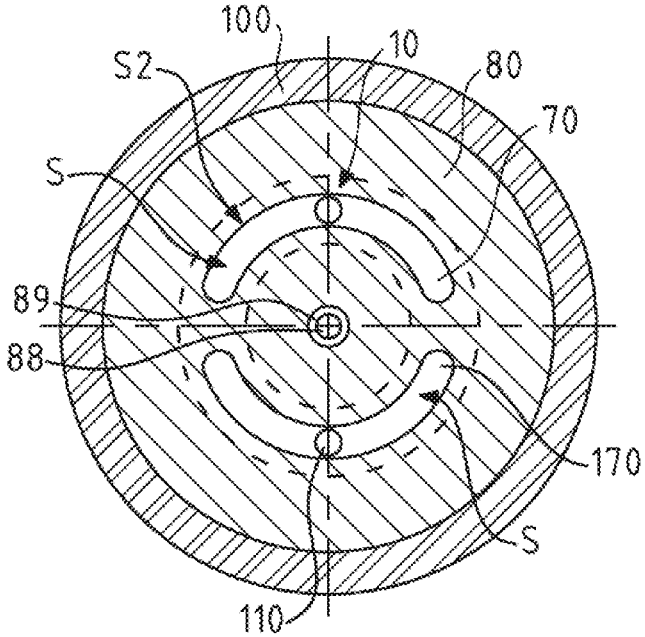
FIG. 4 is a cross-sectional view of the pump of FIG. 1, taken along the section plane BB identified in FIG. 1.
Figure 5:
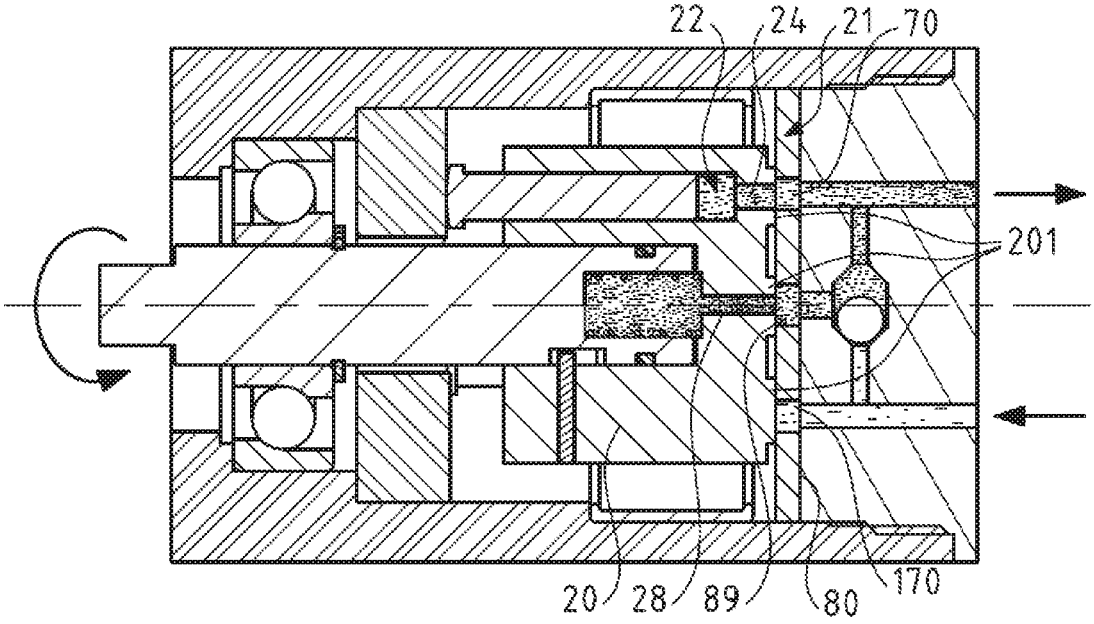
FIG. 5 is a view in longitudinal section of a hydraulic pump according to one embodiment of the invention in which the peripheral area is delimited by a raised part of the rear face of the barrel.
Figure 6:
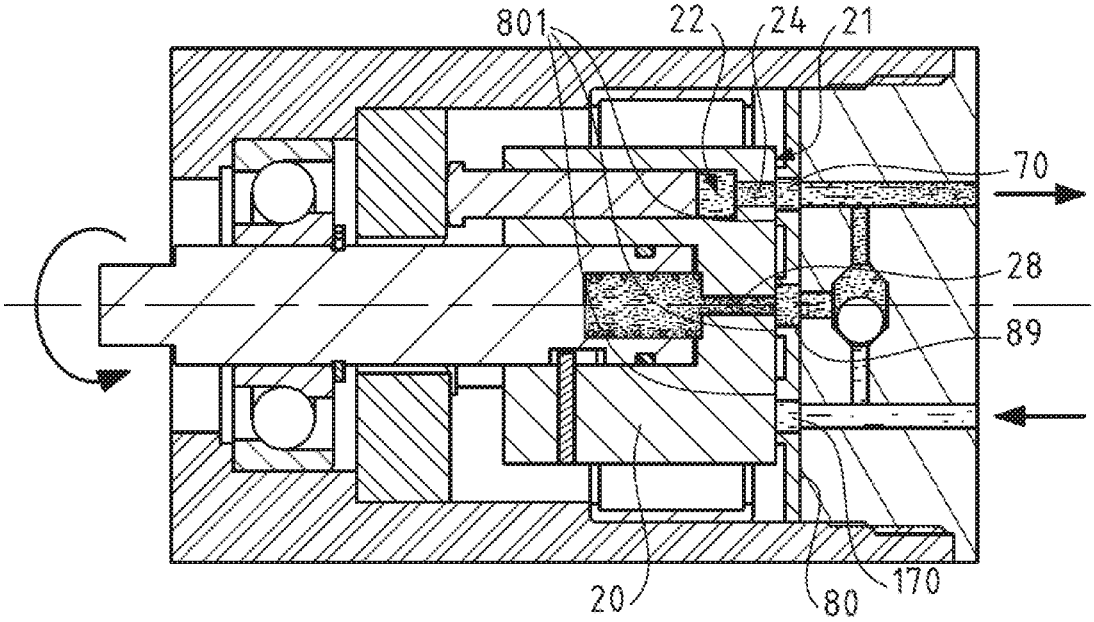
FIG. 6 is a view in longitudinal section of a hydraulic pump according to one embodiment of the invention in which the peripheral area is delimited by a raised part of the front face of the port plate.

With reference to FIG. 4, S denotes the cross section of the distribution port 70. P denotes the pressure of the liquid delivered via the delivery aperture, the delivery pressure. The pressure exerted on the area of the rear face of the barrel facing the distribution port, the bearing area, is equal to the delivery pressure P. The pressure exerted on the area of the rear face of the barrel surrounding the bearing area, the peripheral area (delimited by broken lines in FIG. 4), decreases between a value equal to the delivery pressure P, at the junction with the bearing area, and a value equal to the pressure established in the pump casing, at a position where the rear face of the barrel is not in contact with the port plate. $S_2$ denotes the surface of the peripheral area. The peripheral area may be delimited by a raised part 201 of the rear face of the barrel around the mouths of the piston channels 24 and of the balancing channel 28 (as shown in FIG. 5) and/or a raised part 801 of the front face of the port plate around the distribution ports 70 and 170 and the balancing port 89 (as shown in FIG. 6). The compressive force exerted by the fluid on the bearing section, tending to move the barrel 20 away from the port plate 80, is written $$PS + \frac{P}{2}S_2.$$

it s denotes the cross section of the pistons 3 and n denotes the number of pistons 3 subjected to the delivery pressure, the compressive force exerted by the fluid on the end walls of the piston housings and tending to move the barrel 20 toward from the port plate 80 is expressed as Pns. During the rotation of the pump, the number of pistons 3 subjected to the delivery pressure alternates between $$\frac{N-1}{2} \text{ and } \frac{N+1}{2},$$

where N is the number of pistons in the pump.

The barrel 20 is in sliding connection (also called slideway connection) with the shaft 30; in other words, the barrel 20 is connected in rotation but free in translation relative to the shaft 30 along the axis A.

For this purpose, the shaft 30 may have a longitudinal groove 33, the barrel 20 having a hole 29, possibly a through hole, a key 25 being placed between the longitudinal groove 33 formed in the shaft 30 and the hole 29 formed in the barrel 20, so that the key 25 is fixed to the barrel 20 and free in translation along the longitudinal groove 33.

Alternatively, the shaft 30 may have longitudinal splines, the longitudinal cylindrical wall of the housing 27 having splines complementary to those of the shaft 30, the splines of the shaft 30 and the splines of the housing 27 combining to form a sliding connection.

The translation of the shaft 30 relative to the casing 100 in the direction of the axis A is limited, at least in the direction in which the shaft 30 moves away from the barrel 20. For this purpose, the pump comprises a thrust bearing 31, supporting the shaft 30 and guiding it in rotation. The rotation of the shaft 30 relative to the thrust bearing 31 may, preferably, be facilitated by bearings. The thrust bearing 31 also serves to hold the shaft 30 in its axial direction and prevents the shaft 30 from moving along its axis A in the direction in which the shaft moves away from the port plate. In one embodiment, the shaft 30 may be equipped with a collar 32 pressing on a rear face 39 of the bearing 31, and with a counter ring if necessary. The counter ring is made of treated steel, for example, and may be equipped with grooves to create a film of oil that facilitates rotation. The collar 32 may be cut from the body of the shaft or may be applied in a radial groove formed in the shaft 30. The thrust bearing 31 may also be adapted to prevent the shaft 30 from moving along its axis A in the direction in which the shaft moves toward from the port plate. For this purpose, the shaft 30 may, alternatively, be equipped with a second collar (not shown) pressing on a front face of the bearing 31, the second collar resembling the one described above.

A housing 27 having a cross section complementary to the cross section of the shaft 30 is formed in the barrel 20. The shaft 30 slides in the housing 27 and projects from the front face 23 of the barrel 20. The piston housing 27 is defined by a cylindrical longitudinal wall and an end wall. A seal 26, particularly a wiper lip seal, may be interposed between the cylindrical longitudinal wall of the housing 27 and the shaft 30, and preferably may be positioned in a radial groove formed in the shaft 30, to ensure the tightness of the sealing chamber 90 while allowing the translation of the shaft 30 relative to the barrel 20.

The shaft 30 and the barrel 20 combine to form a piston system. The shaft 30 and the barrel 20 combine to define a balancing chamber 90. The movement of the shaft 30 relative to the barrel 20 causes a variation of the volume of the balancing chamber 90.

A cavity 35 may be formed in the shaft 30, the cavity 35 opening from the end of the shaft 30 inserted into the housing 27 formed in the barrel.

The balancing chamber 90 is in fluid communication with the delivery aperture 110 of the pump, so that the balancing chamber 90 is always filled with fluid that is at the delivery pressure.

For this purpose, a balancing conduit 28 formed in the barrel 20 opens, on the one hand, on the end wall of the housing 27, and, on the other hand, on the rear face 21 of the barrel 20. The balancing conduit 28 is centered on the axis A. The port plate 80 has a balancing aperture 89 centered on the axis A. The balancing aperture 89 adjoins the balancing conduit 28 formed in the barrel 20. The balancing aperture 89 communicates with the delivery aperture 110 of the pump through one or more channels formed in the end piece 101.

In the case of a pump operating in both directions, the balancing aperture 89 is connected to the aperture 10 by a first passage 84, and to the aperture 110 by a second passage 83, and the pump comprises a valve 85 configured to connect the balancing aperture 89 to either the first passage 84 or the second passage 83.

In particular, the passages 83 and 84 may be connected to a valve chamber 86, a third inlet that communicates with the balancing aperture 89 via a channel 88. Valve 85 is positioned in the valve chamber 86 and is an object that is capable of shutting off the inlet of the passages 83 and 84. Valve 85 may, preferably, be a ball, the size of which is greater than the diameter of the passages 83 and 84.

Thus, as shown in FIG. 2, when the pump rotates in a direction for which the liquid under pressure is delivered via the aperture 10, valve 85 is pressed by the delivery pressure against the inlet of the second passage 83, so that valve 85 shuts off the second passage 83. The balancing chamber 90 is therefore in fluid communication with the aperture 10, which is the delivery aperture. The fluid in the balancing chamber 90 is therefore at the delivery pressure.

Similarly, as shown in FIG. 1, when the pump rotates in a direction for which the liquid under pressure is delivered via the aperture 110, valve 85 is pressed by the delivery pressure against the inlet of the first passage 84, so that valve 85 shuts off the first passage 84. The balancing chamber 90 is therefore in fluid communication with the aperture 110, which is the delivery aperture. The fluid in the balancing chamber 90 is therefore at the delivery pressure.

In the two configurations corresponding to the two directions of operation of the pump, the fluid contained in the balancing chamber 90 is at the delivery pressure.

The compressive force exerted by the fluid in the balancing chamber 90 tends to move the shaft 30 away from the barrel 20. Since the translation of the shaft 30 relative to the casing 100 is constrained by the thrust bearing 31, the compressive force tends to move the barrel 20 toward the port plate 80.

The compressive force exerted by the liquid under pressure in the balancing chamber 90 on the barrel 20 does not vary with the rotation of the barrel 20 relative to the port plate 80. If Σ denotes the cross section of the balancing chamber 90, the compressive force exerted by the liquid under pressure in the balancing chamber 90 on the barrel 20 is expressed as PΣ. The expression "cross section Σ de la balancing chamber" is taken to mean the maximum cross section of the balancing chamber 90. This is equal to the cross section of the housing 27.

In terms of dimensions, the hydraulic pump must satisfy the following equation, which ensures that the barrel continues to be pressed against the port plate:

$$\sum + \frac{N-1}{2} s > S + \frac{S_2}{2}$$

where $$\frac{N-1}{2}$$

is the smallest number of pistons subjected to the delivery pressure during the rotation of the pump, and, preferably, the following equation which ensures the balancing of the pump:

$$\sum + \frac{N-1}{2} s = \frac{S + \frac{S_2}{2}}{R}$$

where R is between 0.8 and 0.99.

The pump is thus hydrostatically balanced, ensuring that the delivery pressure, which penetrates between the rear face 21 of the barrel 20 and the port plate 80, cannot separate the barrel 20 from the port plate 80.

Additionally, the compressive force exerted by the liquid on the end walls of the piston housings 22 is proportional to the number of pistons subjected to the delivery pressure, and, since the number of pistons subjected to the delivery pressure varies during the rotation of the barrel, the force exerted on the barrel and tending to press the barrel against the port plate varies during the rotation, which disturbs the operation of the hydraulic pump. The cross section Σ of the balancing chamber 90 is preferably more than twice as large as the cross section s of a piston 3, and still more preferably more than ten times as large as the cross section s of a piston 3, thereby preventing excessively large variations of the force that tends to move the barrel toward the port plate. This is because, if the cross section Σ of the balancing chamber 90 is large relative to the cross section s of a piston 3, the compressive force exerted by the liquid under pressure in the balancing chamber 90 on the barrel 20 is large relative to the compressive force exerted by the liquid on the end walls of the piston housings 22, and the variation of the force tending to move the barrel 20 toward the port plate 80 during the rotation of the shaft 30 is negligible. Because of these arrangements, the hydrostatic balancing of the barrel 20 may be provided by the appropriate sizing of the cross sections of the piston housings 22 and the balancing chamber 90. Because of these arrangements, the tightness of the port plate 80 is not adversely affected.

The rear face 21 of the barrel 20 may also be kept bearing against the port plate 80 by a return member 9, typically a compression spring, such as a helical spring, which bears against the shaft 30 on the one hand, and against the barrel 20 on the other hand. In particular, the return member 9 may be positioned in the housing 27 and may bear against the end wall of the cavity 35 formed in the shaft 30, on the one hand, and against the end wall of the housing 27 formed in the barrel 20, on the other hand. The return member 9 enables the barrel to be kept pressed against the port plate when the hydraulic pump is not in operation.

Although the invention has been described with reference to particular embodiments, it is evidently not limited in any way by this, and comprises all the technical equivalents of the means described and their combinations where these fall within the scope of the invention.

The use of the verb "to have", "to comprise" or "to include" and any of its conjugated forms does not exclude the presence of elements or steps other than those stated in a claim. The use of the indefinite article "a" or "an" for an element does not exclude the presence of a plurality of such elements unless otherwise specified.

The invention claimed is:

1. A hydraulic pump comprising:

a casing in which a first aperture and a second aperture are arranged, one of the first and second apertures being an intake aperture and the other being a delivery aperture, a shaft mounted rotatably in the casing, a swash plate fixed to the casing, a barrel in sliding connection with the shaft and driven in rotation by the shaft around an axis, with piston housings being formed in the barrel, at least three pistons, each sliding in one of the piston housings, the pistons projecting from a front face of the barrel and bearing against the swash plate, a port plate bearing against the rear face of the barrel, the port plate having a first port connected to the first aperture and a second port connected to the second aperture, a housing being formed in the barrel, the shaft being engaged in the housing and projecting from the front face of the barrel, the housing and the shaft defining between them a balancing chamber, the balancing chamber being connected to the delivery aperture through the casing in such a way that a fluid in the balancing chamber exerts a compressive force on the barrel which tends to press the barrel against the port plate, wherein a balancing conduit is formed in the barrel, the balancing conduit connecting the balancing chamber to the rear face of the barrel, the port plate having a balancing aperture connected to the delivery aperture through the casing, the balancing aperture adjoining the balancing conduit.

2. The hydraulic pump as claimed in claim 1, comprising a key placed between a longitudinal groove formed in the shaft and a hole formed in the barrel, so that the key provides the sliding connection between the barrel and the shaft.

3. The hydraulic pump as claimed in claim 1, wherein the shaft has longitudinal splines, a cylindrical longitudinal wall of the housing having complementary splines, the splines of the shaft and the splines of the housing combining to form the sliding connection.

4. The hydraulic pump as claimed in claim 1, wherein a cavity is formed in the shaft, the cavity opening from the rear end of the shaft in the housing formed in the barrel.

5. The hydraulic pump as claimed in claim 1, further comprising a seal interposed between a cylindrical longitudinal wall of the housing and the shaft.

6. The hydraulic pump as claimed in claim 1, wherein the balancing conduit and the balancing aperture are centered on the axis.

7. The hydraulic pump as claimed in claim 1, wherein a cross section Σ of the balancing chamber, a cross section s of a piston, a cross section S of a distribution port, a surface $S_2$ of the area on the rear face of the barrel subjected to a pressure in a range between a delivery pressure P and a pressure established in the pump casing, and N, the number of pistons in the pump, satisfy the following equation:

$$\sum + \frac{N-1}{2} s > S + \frac{S_2}{2}.$$

8. The hydraulic pump as claimed in claim 1, wherein a cross section Σ of the balancing chamber is more than twice as large as a cross section s of a piston.

9. A hydraulic pump comprising:

a casing in which a first aperture and a second aperture are arranged, one of the first and second apertures being an intake aperture and the other being a delivery aperture, a shaft mounted rotatably in the casing, a swash plate fixed to the casing, a barrel in sliding connection with the shaft and driven in rotation by the shaft around an axis, with piston housings being formed in the barrel, at least three pistons, each sliding in one of the piston housings, the pistons projecting from a front face of the barrel and bearing against the swash plate, a port plate bearing against the rear face of the barrel, the port plate having a first port connected to the first aperture and a second port connected to the second aperture, a housing being formed in the barrel, the shaft being engaged in the housing and projecting from the front face of the barrel, the housing and the shaft defining between them a balancing chamber, the balancing chamber being connected to the delivery aperture through the casing in such a way that a fluid in the balancing chamber exerts a compressive force on the barrel which tends to press the barrel against the port plate, wherein the hydraulic pump is capable of operation in both directions of rotation of the shaft, wherein, in a first direction of rotation of the shaft, the first aperture forms the intake aperture and the second aperture forms the delivery aperture, and, in the second direction of rotation of the shaft, the second aperture forms the intake aperture and the first aperture forms the delivery aperture, further comprising a valve housed in the casing and configured to connect the balancing chamber selectively to the first or to the second aperture, according to the direction of rotation.

10. The hydraulic pump as claimed in claim 1, capable of operation in both directions of rotation of the shaft, wherein, in a first direction of rotation of the shaft, the first aperture forms the intake aperture and the second aperture forms the delivery aperture, and, in the second direction of rotation of the shaft, the second aperture forms the intake aperture and the first aperture forms the delivery aperture, further comprising a valve housed in the casing and configured to connect the balancing chamber selectively to the first or to the second aperture, according to the direction of rotation.

11. The hydraulic pump as claimed in claim 10, wherein the balancing chamber is connected to the first aperture by a first passage and to the second aperture by a second passage, the valve being a ball whose diameter is greater than the diameter of the first and second passages, so that the valve is pressed by the pressure of the liquid delivered by the delivery aperture against the entry of the passage connected to the intake aperture.

12. The hydraulic pump as claimed in claim 9, wherein the balancing chamber is connected to the first aperture by a first passage and to the second aperture by a second passage, the valve being a ball whose diameter is greater than the diameter of the first and second passages, so that the valve is pressed by the pressure of the liquid delivered by the delivery aperture against the entry of the passage connected to the intake aperture.

13. The hydraulic pump as claimed in claim 1, further comprising a return member which bears against the shaft and against the barrel, to exert an elastic force tending to press the barrel against the port plate.

14. The hydraulic pump as claimed in claim 1, comprising a thrust bearing supporting the shaft and guiding it in rotation, while limiting the translation of the shaft relative to the casing in the direction of the axis, at least in the direction in which the shaft moves away from the barrel.

15. The hydraulic pump as claimed in claim 14, wherein the shaft is equipped with a collar pressing on a rear face of the thrust bearing.

16. The hydraulic pump as claimed in claim 9, comprising a key placed between a longitudinal groove formed in the shaft and a hole formed in the barrel, so that the key provides the sliding connection between the barrel and the shaft.

17. The hydraulic pump as claimed in claim 9, wherein the shaft has longitudinal splines, a cylindrical longitudinal wall of the housing having complementary splines, the splines of the shaft and the splines of the housing combining to form the sliding connection.

18. The hydraulic pump as claimed in claim 9, wherein a cavity is formed in the shaft, the cavity opening from the rear end of the shaft in the housing formed in the barrel.

19. The hydraulic pump as claimed in claim 9, further comprising a seal interposed between a cylindrical longitudinal wall of the housing and the shaft.

20. The hydraulic pump as claimed in claim 9, wherein the balancing conduit and the balancing aperture are centered on the axis.

21. The hydraulic pump as claimed in claim 9, wherein a cross section Σ of the balancing chamber, a cross section s of a piston, a cross section S of a distribution port, a surface $S_2$ of the area on the rear face of the barrel subjected to a pressure in a range between a delivery pressure P and a pressure established in the pump casing, and N, the number of pistons in the pump, satisfy the following equation:

$$\sum + \frac{N-1}{2} s > S + \frac{S_2}{2}.$$

22. The hydraulic pump as claimed in claim 9, wherein a cross section Σ of the balancing chamber is more than twice as large as a cross section s of a piston.

23. The hydraulic pump as claimed in claim 9, further comprising a return member which bears against the shaft and against the barrel, to exert an elastic force tending to press the barrel against the port plate.

24. The hydraulic pump as claimed in claim 9, comprising a thrust bearing supporting the shaft and guiding it in rotation, while limiting the translation of the shaft relative to the casing in the direction of the axis, at least in the direction in which the shaft moves away from the barrel.

* * * * *